US010492975B2

(12) United States Patent
Mangino, Jr.

(10) Patent No.: US 10,492,975 B2
(45) Date of Patent: Dec. 3, 2019

(54) FULL-BODY MASSAGE APPARATUS, AND METHODS OF MAKING AND USING SAME

(71) Applicant: William J. Mangino, Jr., South Windsor, CT (US)

(72) Inventor: William J. Mangino, Jr., South Windsor, CT (US)

( * ) Notice: Subject to any disclaimer, the term of this patent is extended or adjusted under 35 U.S.C. 154(b) by 0 days.

(21) Appl. No.: 15/690,502

(22) Filed: Aug. 30, 2017

(65) Prior Publication Data

US 2019/0060153 A1 Feb. 28, 2019

(51) Int. Cl.

| | |
|---|---|
| ***A61H 1/02*** | (2006.01) |
| ***A61H 7/00*** | (2006.01) |
| ***A61H 15/00*** | (2006.01) |
| ***A61H 1/00*** | (2006.01) |

(52) U.S. Cl.

CPC ..... *A61H 1/02* (2013.01); *A61H 1/00* (2013.01); *A61H 1/0292* (2013.01); *A61H 1/0296* (2013.01); *A61H 7/001* (2013.01); *A61H 15/00* (2013.01); *A61H 2015/0014* (2013.01); *A61H 2201/0157* (2013.01); *A61H 2201/0161* (2013.01); *A61H 2201/0192* (2013.01); *A61H 2205/04* (2013.01); *A61H 2205/081* (2013.01)

(58) Field of Classification Search

CPC ..... A61H 1/0292; A61H 1/0296; A61H 2015/0014; A61H 2015/0021; A61H 2205/04; A61H 2205/081; A61H 1/02; A63B 1/00; A63B 3/00

See application file for complete search history.

(56) References Cited

U.S. PATENT DOCUMENTS

| | | | | |
|---|---|---|---|---|
| 3,653,658 A * | 4/1972 | Robertson | A63B 3/00 482/23 |
| 5,352,188 A * | 10/1994 | Vitko | A61H 15/00 601/115 |
| 5,913,758 A * | 6/1999 | Nunez | A61H 1/0292 482/140 |
| 5,928,119 A * | 7/1999 | Dinkel | A63B 21/00047 482/141 |
| 5,931,769 A * | 8/1999 | Nunez | A61H 1/0292 482/121 |

(Continued)

FOREIGN PATENT DOCUMENTS

| | | |
|---|---|---|
| CN | 102579226 | 7/2012 |
| CN | 204601469 | 9/2015 |

OTHER PUBLICATIONS www.walmart.com, Ab Rocket Abdominal Trainer Exercise Workout Machine, 10 pages, (viewed Oct. 29, 2016), https://www.walmart.com/ip/Ab-Rocket-Abdominal-Trainer-Exercise-Workout-Machine-As-Seen-on-TV-Blue/8073571.

(Continued)

*Primary Examiner* — Valerie L Woodward

(74) *Attorney, Agent, or Firm* — UConn IP Law Clinic; Gabrielle L. Gelozin; Christopher A. Holshouser

(57) ABSTRACT

A body massaging apparatus is described that includes a support frame, a generally horizontal neck massage bar mounted to the support frame, and a generally horizontal back massage bar mounted to the support frame at a position beneath and in front of the neck massage bar, with the area bounded by the left front support member, right front support member, neck massage bar and back massage bar being an open space. Methods of making and using the apparatus also are disclosed.

20 Claims, 7 Drawing Sheets

(56) References Cited

U.S. PATENT DOCUMENTS

| | | | | |
|---|---|---|---|---|
| 6,217,538 | B1 | 4/2001 | Anderson | |
| 6,375,601 | B1 * | 4/2002 | Johnson | A61H 1/0292 297/452.13 |
| 6,422,982 | B1 * | 7/2002 | Retel | A61H 1/0218 482/143 |
| 6,468,192 | B1 * | 10/2002 | Doerscheln | A61H 1/0229 482/142 |
| 6,569,069 | B1 * | 5/2003 | Linares | A61H 1/0292 482/140 |
| 8,801,579 | B2 | 8/2014 | Beck et al. | |
| 9,327,153 | B2 * | 5/2016 | Wallisch | A63B 3/00 |
| 9,463,133 | B2 | 10/2016 | Rodgers | |
| D796,053 | S | 8/2017 | Phillips | |
| 2005/0003938 | A1 * | 1/2005 | Henderson | A63B 21/068 482/143 |
| 2015/0297931 | A1 * | 10/2015 | Cha | A63B 1/00 482/38 |

OTHER PUBLICATIONS www.walmart.com, Sunny Health & Fitness SF-BH6504 Hyperextension Roman Chair, 8 pages, (viewed Oct. 29, 2016), https://www.walmart.com/ip/Sunny-Health-Fitness-SF-BH6504-Hyperextension-Roman-Chair/45090893.

www.walmart.com, As Seen on TV Chair Gym, 8 pages, (viewed Oct. 29, 2016), https://www.walmart.com/ip/As-Seen-on-TV-Chair-Gym/25440951.

www.themindrelaxer.com, The Foldaway Barre Studio, X pages, (Oct. 31, 2015), http://www.themindrelaxer.com/the-foldaway-barre-studio-a-home-barre-studio-design-to-improve-flexibility-balance-and-develop-long-lean-muscles/.

* cited by examiner

FULL-BODY MASSAGE APPARATUS, AND METHODS OF MAKING AND USING SAME

BACKGROUND

Athletes who undergo regular and/or intense physical training often develop sore or stiff muscles. The best relief for these conditions is often massage therapy. However, massage therapy can be expensive and is not always available or practical.

Various movable and stationary products are known for use in stretching and massaging muscles before and after exercise. However, the simplistic design of these products limits the user to focusing on one muscle or muscle area at a time, and the massage rollers have varied effectiveness typically based on an individual's body weight.

It would be useful to develop a product that overcomes the limitations of current products used for athletic massage.

SUMMARY

One embodiment is a body massage apparatus comprising a support frame including a left front support member, a right front support member, a left rear support member and a right rear support member. The left and right front support members extend generally upwardly from a floor or other horizontal surface and are parallel to each other with a horizontal distance between them. The left and right rear support members extend generally upwardly from the floor or other horizontal surface and are parallel to each other with a horizontal distance between them. The left rear support member connects to the left front support member, and the right rear support member connects to the right front support member. The apparatus also includes a generally horizontal neck massage bar mounted to the support frame, and a generally horizontal back massage bar mounted to the support frame at a position beneath and in front of the neck massage bar. The area bounded by the left front support member, right front support member, neck massage bar and back massage bar is an open space.

Another embodiment is a method to stretch and/or massage muscles, comprising obtaining the apparatus described in the previous paragraph, and moving a user's body so that parts of at least one of the user's lower back and leg contacts and moves over the surface of the second horizontal massage bar, and at least one of the user's neck, upper back, arm and hands contacts the surface of the first horizontal massage bar.

A further embodiment is a method of making the apparatus described above.

BRIEF DESCRIPTION OF THE DRAWINGS

The embodiments disclosed herein will be understood and appreciated more fully from the following detailed description taken in conjunction with the drawings in which.

DETAILED DESCRIPTION

Figure 1:
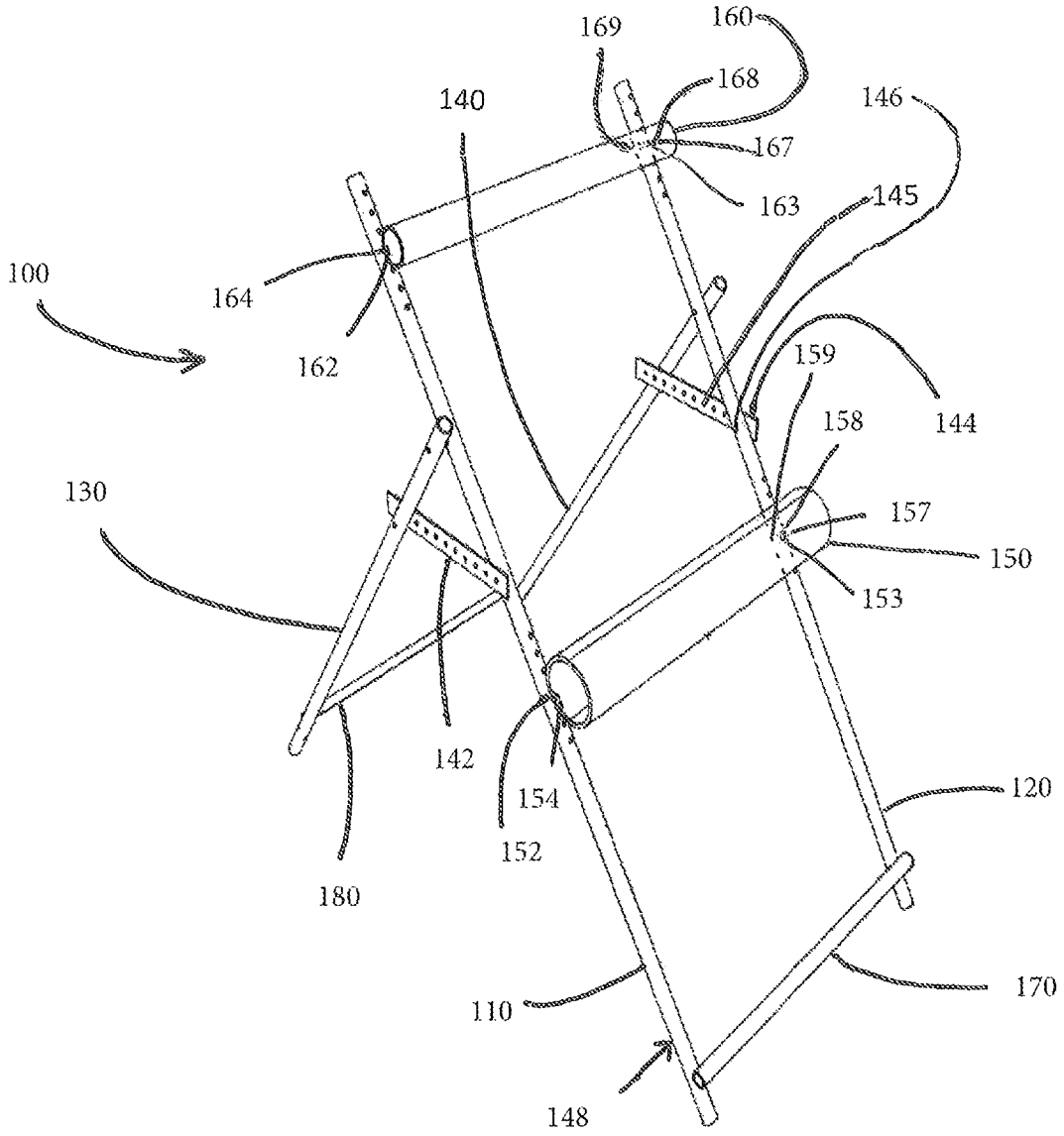
FIG. 1 depicts a perspective view of a first embodiment of an assembled body massaging apparatus.
Figure 2:
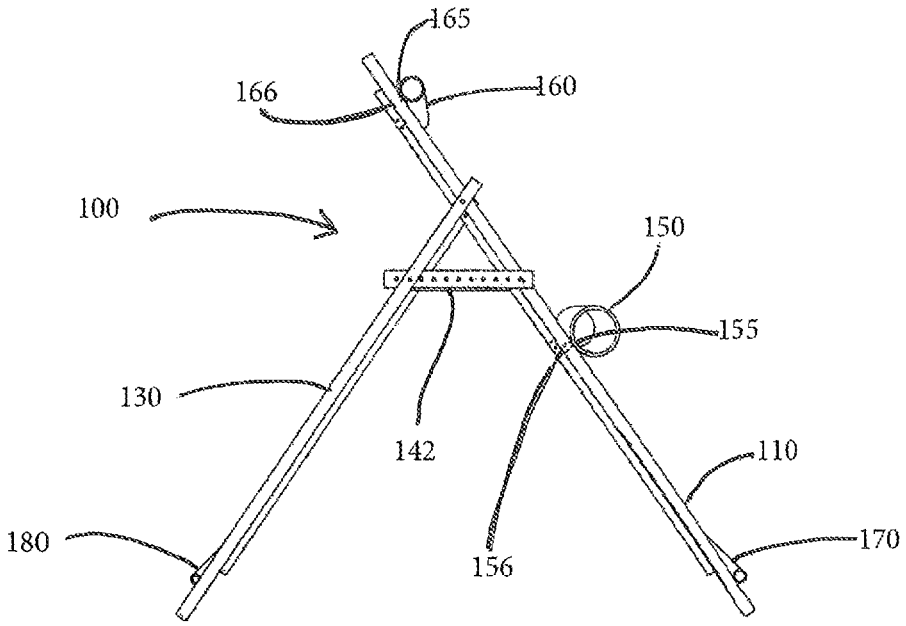
FIG. 2 is a side view of the apparatus of FIG. 1.

The massage apparatus and method of use provide users with a solution for efficiently self-massaging and stretching multiple muscles and muscle groups in a single continuous session of use. Additionally, the dimensions, height and self-supporting features of the apparatus allow users to better control the amount of bodyweight applied to a particular muscle or muscle group. The user is able to lean on, and/or press against, the massage bars, focusing on the muscles they wish to massage with a desired amount of pressure. In embodiments, the height of the massage bars is adjustable, and the apparatus can be folded for compact storage and transport.

As used herein, the term "massage roller" means a stationary, curved surface configured to be contacted by a user for massaging and/or stretching muscles. The massage roller may be rotatable or stationary. A massage roller is a type of massage bar. As used herein, the term "foot platform" means a component configured to receive and support a user's foot during use of the apparatus. The foot platform may also be configured for massaging the bottom of the user's foot or feet. The foot platform may be rotatable or stationary.

In one embodiment, as shown in FIG. 1-4, the body massaging apparatus 100 comprises a left front support tube or member 110 and a right front support tube or member 120 extending generally upwardly from a floor or other horizontal surface. The left front support tube 110 and right front support tube 120 are connected to one another by an upper horizontal massage roller 160 and a lower horizontal massage roller 150. The upper horizontal massage roller 160 and lower horizontal massage roller 150 maintain the left front support tube 110 and right front support tube 120 substantially parallel to one another at a horizontal distance.

The apparatus 100 further comprises a left rear support tube or member 130 and a right rear support tube or member 140 extending generally upwardly from a floor or other horizontal surface. The left rear support tube 130 and the right rear support tube 140 are substantially parallel with a horizontal distance between them. The left rear support tube 130 connects to the left front support tube 110 and the right rear support tube 140 connects to the right front support tube 120 as depicted in FIG. 1. The support tubes 110, 120, 130 and 140 together form a support frame 148 for the rollers 150 and 160. In embodiments, at least one of the upper horizontal massage roller 160 and the lower horizontal massage roller 150 is mounted to the left front support tube 110 and the right front support tube 120.

In the embodiment shown in FIGS. 1-4, the apparatus 100 is further stabilized by connecting the left front support tube 110 to the right front support tube 120 using a front reinforcing support bar 170, and by connecting the left rear support tube 130 to the right rear support tube 140 using a rear reinforcing support bar 180. In other embodiments, the left front support tube 110, front reinforcing support bar 170, and right front support tube 120 are formed as a one-piece component. In some embodiments, the left rear support tube 130, the rear reinforcing support bar 180, and right rear support tube 140 are formed as a one-piece component.

As depicted in FIG. 1, a left angle-adjustment bracket 142 is used to connect the middle portion of the left front support tube 110 and the upper end of the left rear support tube 130, and a right angle-adjustment bracket 144 is used to connect the middle portion of the right front support tube 120 and the upper end of the right rear support tube 140. The angle adjustment brackets 142, 144 provide additional structural support to the roller frame as well as allowing a user to adjust the angle between the left front support tube 110 and left rear support tube 130 and the right front support tube 120 and right rear support tube 140. By adjusting the length of the angle adjustment brackets 142, 144 between the front support tubes 110, 120 and rear support tubes 130, 140, a user can modify the roller frame 100 for different body shapes and sizes as well as different stretches and exercises. For example, by decreasing the effective length of the angle adjustment brackets 142, 144 between the front support tubes 110, 120 and rear support tubes 130, 140, a user can decrease the angle between the front support tubes 110, 120 and the vertical as well as slightly increase the height of the upper horizontal bar from the floor and the height of the lower horizontal bar from the floor. In the present exemplary embodiment, adjusting the effective length of the angle adjustment bracket 142, 144 is accomplished using holes 145, usually equally spaced along the length of the angle adjustment brackets 142, 144, and one or more locking pins 146 which connect the angle adjustment brackets 142, 144 into one or both of the front support tubes 110, 120 and rear support tubes 130, 140. In embodiments, adjustment of the angle between the front support tubes 110, 120 and rear support tubes 130, 140 allows a user to adjust the angle of their back relative to the lower horizontal massage roller 150. By adjusting the angle of their back, the user can control the amount of bodyweight applied to a particular muscle or muscle group.

In the present embodiment, as depicted in FIG. 1-4, the upper horizontal massage roller 160 and lower horizontal massage roller 150 are substantially cylindrical in shape. However, one or both of the upper horizontal massage roller 160 and lower horizontal massage roller 150 may have alternative shapes, such as but not limited to squares or triangles. Additionally, the diameter of one or both of the upper horizontal massage roller 160 and lower horizontal massage roller 150 from their longitudinal axes may vary. In this embodiment, the upper horizontal massage roller 160 and lower horizontal massage roller 150 are also fixed and non-rotatable about their longitudinal axes. However, in other embodiments one or both of the upper horizontal massage roller 160 and/or lower horizontal massage roller 150 may be rotatable about their longitudinal axes. To support a large variety of exercises and stretches, one or both of the upper horizontal massage roller 160 and lower horizontal massage roller 150 may have a smooth surface in order to provide minimal friction between the horizontal massage rollers 160, 150 and the user's body. Alternatively, one or both of the upper horizontal massage roller 160 and lower horizontal massage roller 150 may have a rough and/or textured surface to improve the user's grip on the horizontal massage roller 160, 150. Non-limiting examples of suitable textured surfaces include protruding or recessed patterned surfaces, such as grooves, ribs, ridges, bumps, dimples, etc.

In embodiments, the height of the lower horizontal massage roller 150 and thus also the spacing of the rollers 150, 160 relative to one another, can be adjusted by utilizing removable fasteners 152, 153 to attach the lower horizontal massage roller 150 to the left and right front support tubes 110, 120. Similarly, the height of the upper horizontal massage roller 160 can be configured to be adjustable by attaching the upper horizontal massage roller 160 to the left and right front support tubes 110, 120 with removable fasteners 162, 163. In the embodiment shown in FIGS. 1-4, the removable fasteners 152, 153, 162, 163 are locking pins configured to be received in openings on opposite ends of the upper and lower horizontal massage rollers 150, 160, as well as and openings the left and right front support tubes 110, 120. More specifically, in the embodiment shown, removable fastener 152 extends through aperture 154 on the lower horizontal massage roller 150 and one of the pairs of adjacent holes 155 and 156 on the left front support tube 110. Similarly, removable fastener 153 extends through aperture 157 on the lower horizontal massage roller 150 and one of the pairs of adjacent holes 158 and 159 on the right front support tube 120. In the embodiment shown, removable fastener 162 extends through aperture 164 on the upper horizontal massage roller 160 and one of the pairs of adjacent holes 165 and 166 on the left front support tube 110. Removable fastener 163 extends through aperture 167 on the upper horizontal massage roller 160 and one of the pairs of adjacent holes 168 and 169 on the right front support tube 120. Other types of suitable fastening systems can be used.

Figure 4:
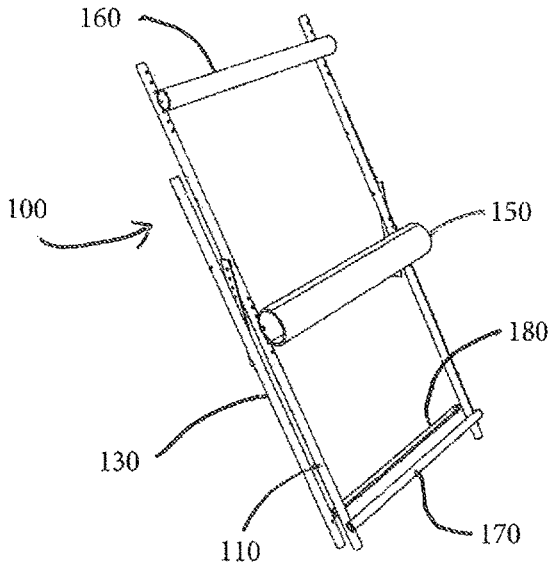
FIG. 4 depicts a perspective view of the apparatus of FIG. 1 in a folded configuration.

As can be understood from FIG. 4, the structure of the roller frame 100 can be folded by the user to place the roller frame 100 in a compact arrangement suitable for storage and transport. In the embodiment shown, the frame 100 can be folded by removing the locking pins 146 from the left and right front support tubes 110, 120, and/or the left and right rear support tubes 130, 140. Other suitable configurations, such as hinged brackets, 142, 144 can be used to enable the frame to be folded.

Figure 3:
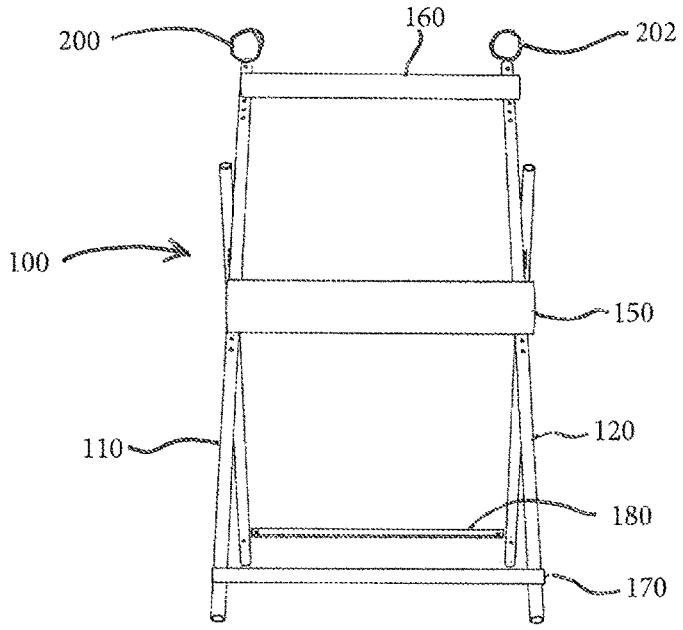
FIG. 3 is a front view of the apparatus of FIG. 1.

As shown in FIG. 3, the roller frame further comprises one or more shoulder massage knobs 200, 202 installed on the upper ends of one or both of the front support tubes 110, 120. In embodiments in which the upper ends of the rear support tubes are higher than the upper ends of the front support tubes, the shoulder massage knobs can be positioned on the upper ends of one or both of the rear support tubes 130, 140. In embodiments, the knobs have a diameter in the range of about 0.5 inches to about 6 inches, or about 1 to about 5 inches, or about 1 to about 4 inches. The outer surfaces of the knobs 200, 202 can be smooth, or they can be rough or textured. Non-limiting examples of suitable textures include protruding or recessed patterned outer surfaces, such as grooves, ribs, ridges, bumps, spikes, dimples, etc.

Figure 5:
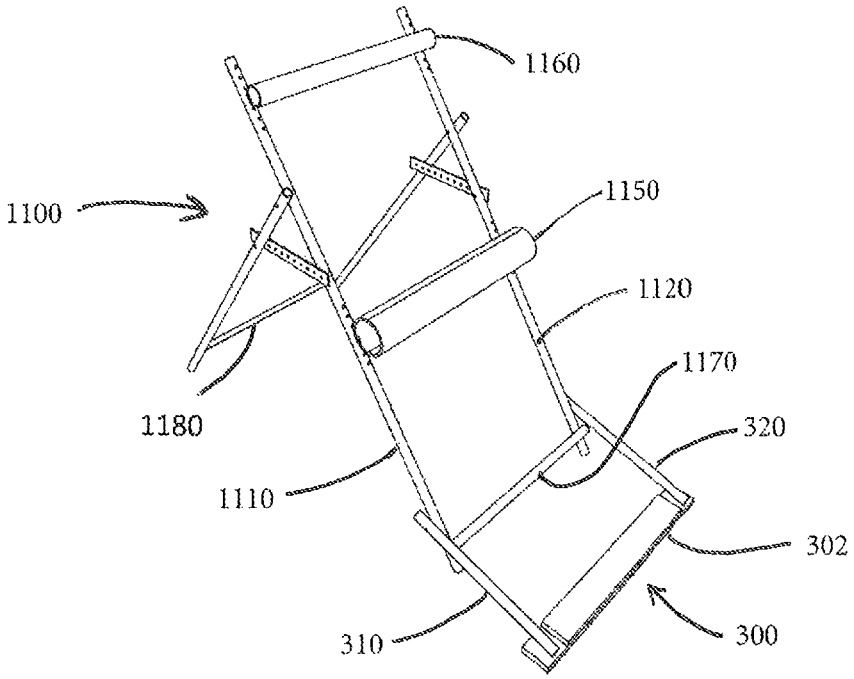
FIG. 5 depicts a perspective view of a second embodiment of a body massaging apparatus, which includes a foot platform.
Figure 6:
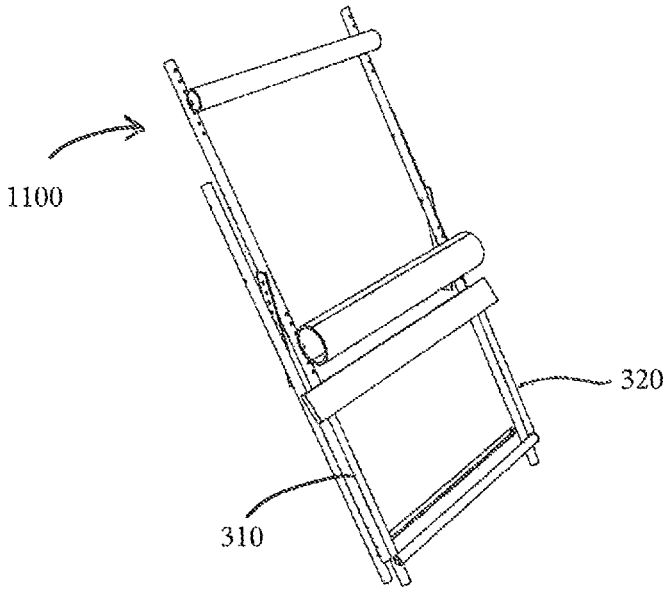
FIG. 6 depicts a perspective view of the apparatus of FIG. 5 in a folded configuration.

In an alternative embodiment shown in FIGS. 5-6, a body massaging apparatus 1100 that includes an upper horizontal massage roller 1160 and a lower horizontal massage roller 1150, a front reinforcing support bar 1170 and a rear reinforcing support bar 1180, further comprises a foot platform 300. The foot platform 300 provides the user of the apparatus 1100 with leverage during stretching and massaging, and improves stability of the apparatus. The foot platform optionally can be structured to enable the user to massage their foot or feet. The foot platform 300 includes a foot receiving section 302 that is disposed horizontally at or near the floor or other horizontal surface during use. The foot receiving section 302 is connected to a left front support tube 1110 by a left foot rest extension tube 310, and to the right front support tube 1120 by a right foot rest extension tube 320. In this embodiment, the foot receiving section 302 is fixed and non-rotatable about its longitudinal axis, however, in other embodiments the foot receiving section 302 may be rotatable about its longitudinal axis. Non-limiting examples of suitable cross-sectional shapes for the foot platform 300 include rectangles, squares, and other shapes with angular edges. These shapes permit the foot platform 300 to be used as a foot rest while also allowing the user to massage the bottom of their feet along the angular edges. In other embodiments, the foot platform 300 has a circular or oval shaped cross section and primarily serves as a foot massager. In embodiments, the foot platform 300 is removably mounted and platforms 300 having various cross sectional shapes can be used interchangeably. In the embodiment shown in FIGS. 5-6, the foot platform 300 is pivotally connected to the left front support tube 1110 and the right front support tube 1120. In embodiments, the foot platform 300 can have a smooth or textured outer surface. Non-limiting examples of suitable textures include protruding or recessed patterned outer surfaces, such as grooves, ribs, ridges, bumps, spikes, dimples, etc.

As can be understood from FIG. 6, the structure of the roller frame 1100 can be folded by the user to place the roller frame 1100 in a compact arrangement suitable for storage and transport.

The apparatus 100 of FIGS. 1-4 is initially assembled by pivotally attaching the left front and rear support tubes 110, 130 to each other, pivotally attaching the right front and rear support tubes 120, 140 to each other, and mounting the upper and lower rollers to the left and right front support tubes 110, 120. If extra support is desired, the front reinforcing support bar 170 connects the two front support tubes to each other, and the rear reinforcing support bar 180 connects the two rear support tubes to each other. (As mentioned above, the reinforcing bars can be integrally formed with the support tubes). The brackets 142, 144 usually are fixed to either the front support tubes 110, 120 or the rear support tubes 130, 140, and are removably attached to the other of the front support tubes 110, 120 and rear support tubes 130, 140.

Figure 7:
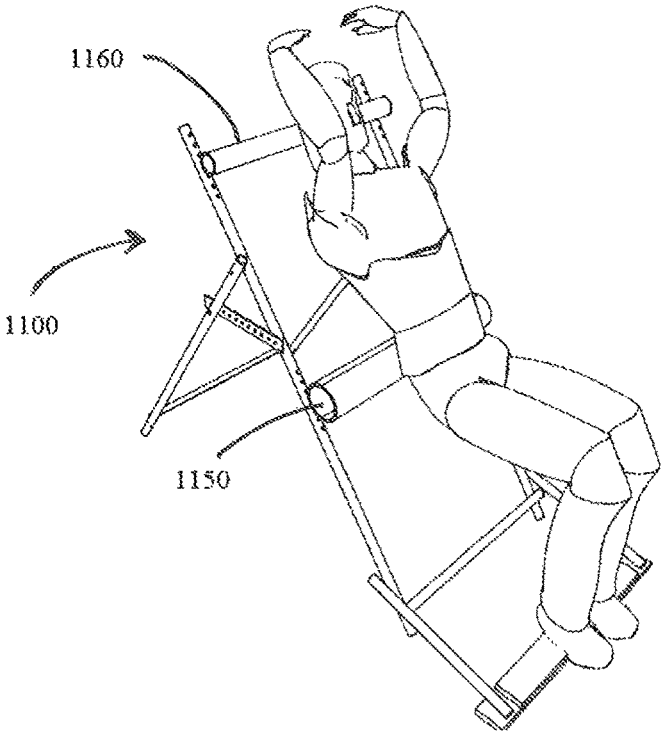
FIG. 7 is a schematic illustration of the apparatus of FIG. 5 being used to treat muscle stiffness.
Figure 8:
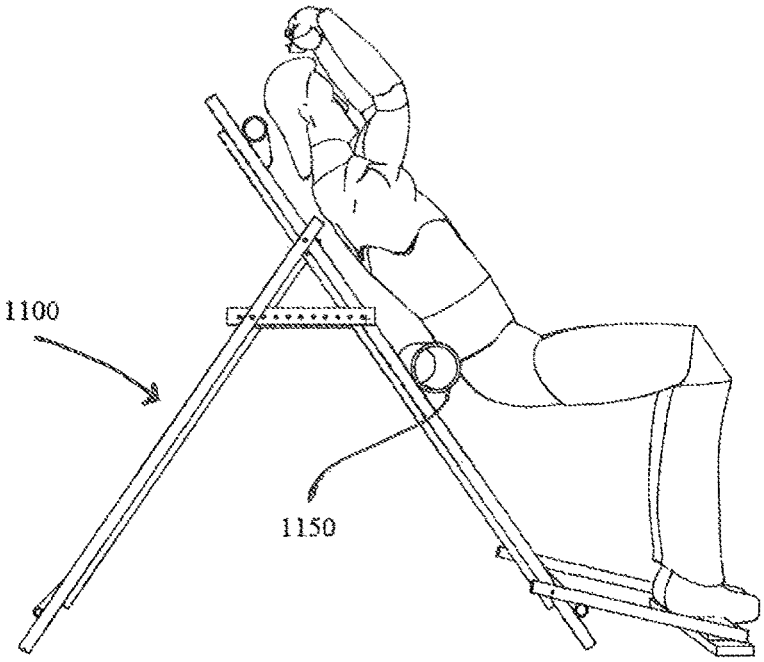
FIG. 8 is a side view of the apparatus and user shown in FIG. 7.
Figure 9:
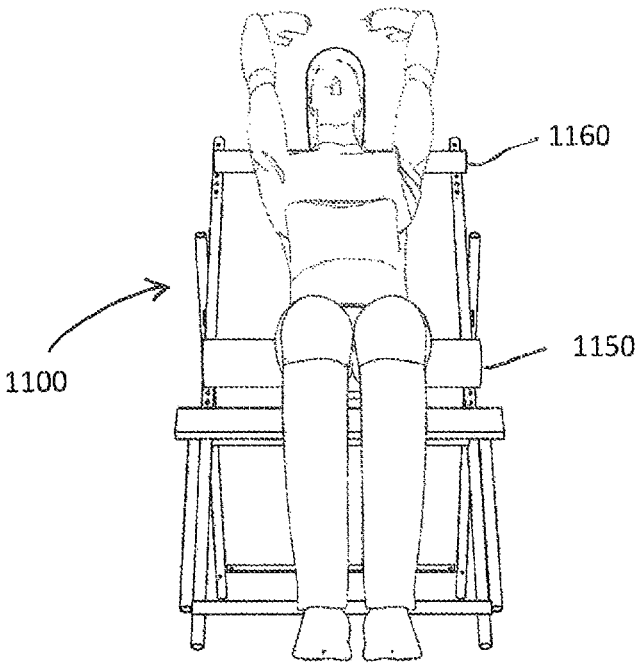
FIG. 9 is a front view of the apparatus and user shown in FIG. 7.

FIGS. 7-9 show the use of the apparatus 1100. In the views shown, the user massages their lower back along the lower horizontal massage roller 1150. The user can massage their arms by placing them on the upper horizontal massage roller 1160 and moving them along the upper horizontal massage roller 1160. In embodiments, the user stands with their back to the upper massage roller and uses the upper horizontal massage roller 1160 as a hand grip while massaging the middle of their back by moving it along the lower horizontal massage roller 1150. In embodiments, the user can massage their calves and thighs by moving them along the upper surface of the lower horizontal massage roller 1150. Similar to the embodiment of FIGS. 1-4, this embodiment allows for some adjustment of the heights of the rollers 1150 and 1160. As can be seen in FIGS. 7-9, the distance between the upper horizontal massage roller 1160 and the lower horizontal massage roller 1150 is at least an amount appropriate to allow a user to simultaneously massage their neck on the upper horizontal massage roller 1160 and their lower back on the lower horizontal massage roller 1150.

Figure 10:
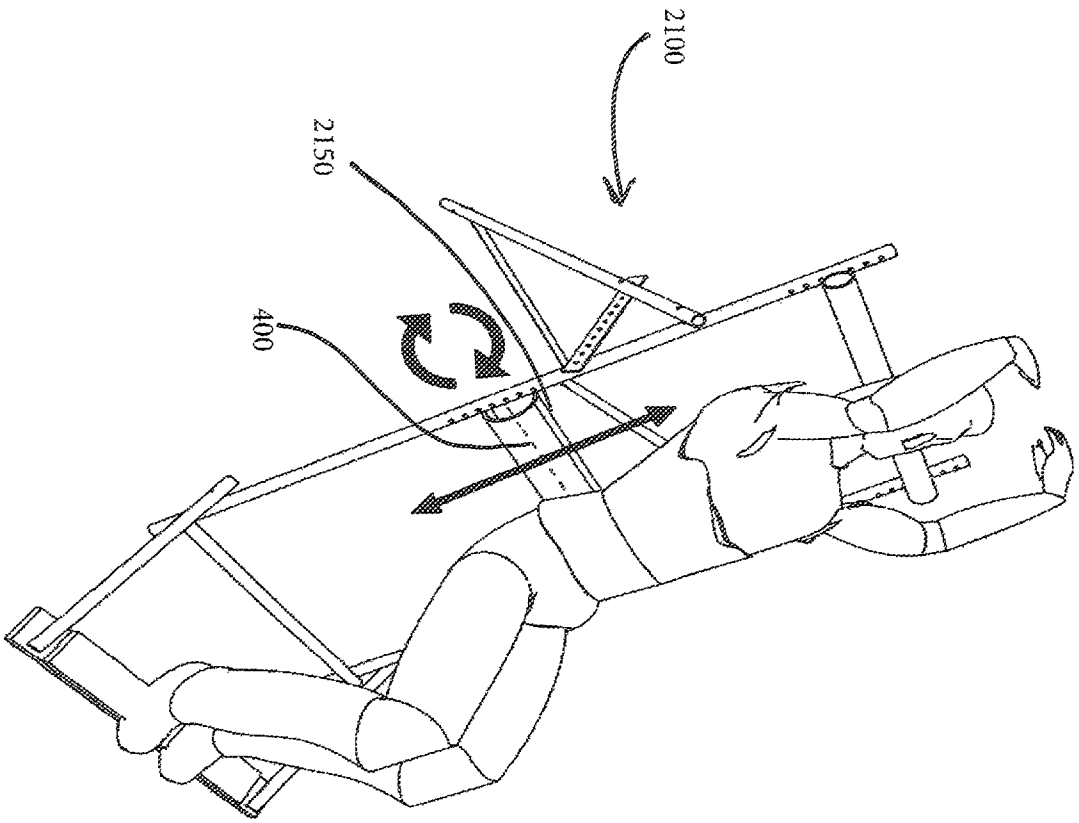
FIG. 10 is a perspective view of a third embodiment of the apparatus having a rotatable massage bar.

FIG. 10 shows an embodiment of an apparatus 2100 in which the lower massage roller 2150 rotates around its central axis. In this embodiment, the lower horizontal massage roller 2150 is mounted on a central axis 400.

In embodiments, at least one of the following is adjustable: the length of the left and right front support members, the length of the left and right rear support members, the height of the neck massage bar above the floor, the height of the back massage bar above the floor, the angle of the left and right front support members from the vertical, and the angle of the left and right rear support members from the vertical. In embodiments, the apparatus lacks a horizontal seat portion.

While FIGS. 1-10 show an apparatus in which the frame is made of hollow cylindrical tubular material and the rollers are also made of hollow tubular material, solid materials can be used. Materials having a rectangular or other cross-sectional shape also can be used for the frame. The rollers usually, but not necessarily, have a curved surface at the intended location of contact with the user's body. Non-limiting examples of suitable materials for the frame include metal, such as aluminum, thermoplastic material, thermoset material, wood, and composites. Non-limiting examples of suitable materials for the rollers include thermoplastic material, including but not limited to polyvinylchloride, thermoset material, metal, wood and composites. Pads or towels can be fastened around the rollers.

In embodiments, the upper and lower massage rollers 160, 150 each have a length in the range of about 20 inches to about 36 inches, or about 20 to about 30 inches, or about 22 to about 26 inches. The reinforcement bars typically have about the same length as the massage rollers. In embodiments, the front support tubes 110, 120 each have a length of about 48 to about 72 inches, or about 40 to about 66 inches, or about 42 to about 62 inches, and the rear support tubes 130, 140 each have a length of about 36 to about 72 inches, or about 40 inches to about 66 inches, or about 42 to about 62 inches. In other cases, the rear support tubes 130, 140 are the same length as, or longer than, the front support tubes 110, 120. In embodiments, during use of the apparatus, the angle between the front support tubes 110, 120 and the rear support tubes 130, 140 can be adjusted within the range of about 47 degrees to about 78 degrees (wide range), or about 55 degrees to about 70 degrees.

In the preferred embodiment of the roller frame 100, as shown in FIGS. 1-4, the upper ends of the rear support tubes 130, 140 connect to the front support tubes 110, 120 at a location below the upper horizontal massage roller 160, as this provides for the inclusion of one or more shoulder massage knobs 200, 202 on the upper ends of the front support tubes 110, 120. In the embodiment shown, the knobs 200, 202 are removable. However, in embodiments the knobs 200, 202 can be permanently fixed to the upper ends of the front support tubes 110 and 120.

In another embodiment (not shown), the left rear support tube 130 can connect to the top of the left front support tube 110, and the right rear support tube 140 can connect to the top of the right front support tube 120. In this embodiment, the shoulder massage knobs 200, 202 could extend upward from the junctions of the front support tubes 110, 120 and rear support tubes 130, 140, or the shoulder massage knobs 200, 202 could be eliminated.

As mentioned above, in another alternative to the illustrated embodiment of the body massaging apparatus 100 (not shown), the upper end of the left front support tube 110 may connect to the left rear support tube 130 at a point below the upper end of the left rear support tube 130. Likewise, in this alternative embodiment, the upper end of the right front support tube 120 may connect to the right rear support tube 140 at a point below the upper end of the right rear support tube 140. In this alternative embodiment, one or more shoulder massage knobs 200 (and 202) may be installed on the upper ends of the rear support tubes 130, 140.

A number of alternatives, modifications, variations, or improvements therein may be subsequently made by those skilled in the art, which are also intended to be encompassed by the following claims.

What is claimed is:

1. A body massaging apparatus, comprising:

a support frame including:

a left front support member and a right front support member extending generally upwardly from a floor or other horizontal surface, the front support members being parallel to each other and having a horizontal distance between them, and a left rear support member and a right rear support member extending generally upwardly from the floor or other horizontal surface, the rear support members being parallel to each other and having a horizontal distance between them, the left rear support member connecting to the left front support member and the right rear support member connecting to the right front support member, a rigid first angle-adjustment bracket and a rigid second angle-adjustment bracket, each of the first and second angle-adjustment brackets pivotally connecting a middle portion of one of the front support members with one of the rear support members, the first and second angle-adjustment brackets being configured to support the apparatus during use, and to permit folding of the apparatus for at least one of storage and transport, a generally horizontal neck massage bar mounted to the support frame wherein the neck massage bar is configured to be in contact with a user's neck while the user's feet are in contact with a floor or other horizontal surface, and a generally horizontal back massage bar mounted to the support frame at a position beneath and in front of the neck massage bar, the distance between the neck massage bar and the back massage bar being adjustable to be an amount appropriate to allow the user to simultaneously massage their neck on the neck massage bar and their lower back on the back massage bar, the area bounded by the left front support member, right front support member, neck massage bar and back massage bar being an open space.

2. The apparatus of claim 1, wherein the neck massage bar is dimensioned to be suitable as a hand grip.

3. The apparatus of claim 1, wherein at least one of the neck massage bar and back massage bar has a smooth outer surface.

4. The apparatus of claim 1, wherein at least one of the neck massage bar and back massage bar is non-rotatable.

5. The apparatus of claim 1, wherein the left front support member is pivotally connected to the left rear support member and the right front support member is pivotally connected to the right rear support member.

6. The apparatus of claim 1, wherein the height of at least one of the neck massage bar and the back massage bar is adjustable.

7. The apparatus of claim 1, wherein each of the left and right front support members has an upper end and a lower end, the apparatus further comprising a generally horizontal front reinforcement bar mounted to the left and right front support members near their lower ends.

8. The apparatus of claim 7, wherein each of the left and right rear support members has an upper end and a lower end, the apparatus further comprising a generally horizontal rear reinforcement bar mounted to the left and right rear support members near their lower ends.

9. The apparatus of claim 1, wherein the neck massage bar and the back massage bar are substantially cylindrical.

10. The apparatus of claim 1, wherein the apparatus lacks a horizontal seat portion.

11. The apparatus of claim 1, further comprising a foot platform connected to the support frame.

12. The apparatus of claim 11, wherein the foot platform is disposed at or near the floor, the foot platform being attached to the support frame by left and right connectors.

13. The apparatus of claim 1, wherein the left and right front support members and the left and right rear support members comprise hollow tubes.

14. The apparatus of claim 1, further comprising at least one shoulder massage knob mounted at the upper end of at least one of the left front support member and the right front support member.

15. The apparatus of claim 14, wherein the at least one shoulder massage knob has a substantially spherical shape.

16. The apparatus of claim 1, wherein at least one of the following is adjustable:

(a) the length of the left and right front support members;

(b) the length of the left and right rear support members;

(c) the height of the neck massage bar above the floor;

(d) the height of the back massage bar above the floor;

(e) the angle of the left and right front support members from the vertical; and (f) the angle of the left and right rear support members from the vertical.

17. The apparatus of claim 1, wherein the support frame is free-standing during use.

18. A body massaging apparatus, comprising:

a support frame including:

a left front support member and a right front support member extending generally upwardly from a floor or other horizontal surface, the front support members being parallel to each other and having a horizontal distance between them, and a left rear support member and a right rear support member extending generally upwardly from the floor or other horizontal surface, the rear support members being parallel to each other and having a horizontal distance between them, the left rear support member connecting to the left front support member and the right rear support member connecting to the right front support member, a generally horizontal neck massage bar mounted to the support frame, and a rotatable generally horizontal back massage bar mounted to the support frame at a position beneath and in front of the neck massage bar, the distance between the neck massage bar and the back massage bar being at least an amount appropriate to allow a user to simultaneously massage their neck on the neck massage bar and their lower back on the back massage bar, the area bounded by the left front support member, right front support member, neck massage bar and back massage bar being an open space.

19. A method to stretch and/or massage muscles, comprising:

obtaining an apparatus comprising:

a support frame including:

a left front support member and a right front support member extending generally upwardly from a floor or other horizontal surface, the front support members being parallel to each other and having a horizontal distance between them, and a left rear support member and a right rear support member extending generally upwardly from the floor or other horizontal surface, the rear support members being parallel to each other and having a horizontal distance between them, the left rear support member connecting to the left front support member and the right rear support member connecting to the right front support member, a generally horizontal first massage bar mounted to the support frame wherein the generally horizontal first massage bar is configured to be in contact with a user's neck while the user's feet are in contact with the floor or other horizontal surface, and a generally horizontal second massage bar mounted to the support frame at a position beneath and in front of the first massage bar, the distance between the first massage bar and the second massage bar being adjustable to a plurality of fixed positions, at least one of the fixed positions being appropriate to allow the user to simultaneously massage their neck on the first massage bar and their lower back on the second massage bar, the area bounded by the left front support member, right front support member, first massage bar and second massage bar being an open space, and moving the user's body so that parts of at least one of the user's lower leg and back contacts and moves over the surface of the second horizontal massage bar, and at least one of the user's neck, upper back, arm and hands contacts the surface of the first horizontal massage bar.

20. The method of claim 19, wherein the apparatus is used to stretch or massage muscles in at least one of a leg, a back, and an arm of the user.

* * * * *